US009993052B2

(12) United States Patent
Williams

(10) Patent No.: US 9,993,052 B2
(45) Date of Patent: Jun. 12, 2018

(54) DEPLOYMENT SYSTEM FOR PORTABLE CANOPY

(71) Applicant: Steven Williams, Ogden, UT (US)

(72) Inventor: Steven Williams, Ogden, UT (US)

( * ) Notice: Subject to any disclaimer, the term of this patent is extended or adjusted under 35 U.S.C. 154(b) by 303 days.

(21) Appl. No.: 14/180,366

(22) Filed: Feb. 14, 2014

(65) Prior Publication Data

US 2015/0230569 A1 Aug. 20, 2015

(51) Int. Cl.

| | |
|---|---|
| ***A45B 11/02*** | (2006.01) |
| ***A45B 23/00*** | (2006.01) |
| ***A45F 3/00*** | (2006.01) |
| ***A45B 25/16*** | (2006.01) |

(52) U.S. Cl.

CPC ..... *A45B 11/02* (2013.01); *A45B 25/16* (2013.01); *A45B 2023/0006* (2013.01); *A45B 2200/1054* (2013.01); *A45F 2003/003* (2013.01)

(58) Field of Classification Search

CPC ..... A45B 11/02; A45B 2023/0006; A45B 2200/1009; A45B 2200/1054; A45B 23/00; A45F 2003/003

See application file for complete search history.

(56) References Cited

U.S. PATENT DOCUMENTS 1,347,540 A * 7/1920 Godard ..... A45B 11/02 224/190
1,460,821 A * 7/1923 Morris ..... A45B 11/02 135/16
1,704,407 A * 3/1929 Rice ..... A45B 11/02 135/16
5,887,771 A * 3/1999 Perry ..... A45B 11/02 224/190
6,053,385 A * 4/2000 Ward ..... A45B 11/00 224/153
6,308,722 B1 * 10/2001 Christie ..... A45B 11/00 135/16
6,776,177 B2 * 8/2004 Wu ..... E04H 15/40 135/135
7,069,939 B1 * 7/2006 Conde ..... A45B 25/00 135/16
8,556,141 B1 * 10/2013 Ferraiolo ..... A45B 17/00 224/186
8,678,019 B2 * 3/2014 Christie ..... A45F 4/02 135/16

(Continued)

*Primary Examiner* — David R Dunn
*Assistant Examiner* — Danielle Jackson
(74) *Attorney, Agent, or Firm* — Steven Rinehart

(57) ABSTRACT

A canopy deployment system provides a user with hands free use of a canopy while obtaining protection from elements. The deployment system integrates with a backpack that fastens to the user. The system controllably holds the canopy, and the user orients the canopy to a desired direction and angle without the use of hands. The user controls the orientation of the canopy by bending, twisting, and swiveling. The canopy is supported by a frame. The frame joins with a central rod. A ring moves along the central rod to release or restrict the frame, and thereby enable a deployed position and a collapsed position. A canopy container contains the canopy and central rod. A deploy cord and a collapse cord extend from the canopy container to actuate the deployed and collapsed positions. The canopy container positions inside a carry container, like a backpack that attaches to a user.

15 Claims, 7 Drawing Sheets

(56) References Cited

U.S. PATENT DOCUMENTS

| | | | | |
|---|---|---|---|---|
| 8,733,378 | B2 * | 5/2014 | Tayebi | A45B 11/02 135/16 |
| 8,777,072 | B2 * | 7/2014 | Christie | A45B 11/02 224/186 |
| 2004/0232186 | A1 * | 11/2004 | Huang | A45B 11/00 224/576 |
| 2005/0161069 | A1 * | 7/2005 | Wu | E04H 15/28 135/98 |
| 2005/0279390 | A1 * | 12/2005 | Omstead | A45B 3/04 135/16 |
| 2007/0039638 | A1 * | 2/2007 | Johnson | A45B 11/02 135/16 |
| 2008/0078790 | A1 * | 4/2008 | Bolling | A45B 11/00 224/190 |
| 2011/0147427 | A1 * | 6/2011 | Weaver | A45B 11/00 224/576 |
| 2012/0273533 | A1 * | 11/2012 | Boden | A45F 3/14 224/190 |
| 2013/0092715 | A1 * | 4/2013 | Tayebi | A45B 11/02 224/576 |
| 2013/0098410 | A1 * | 4/2013 | Prasannakumar | A45B 11/00 135/16 |
| 2013/0233362 | A1 * | 9/2013 | Miller-Klerer | A45B 23/00 135/16 |
| 2013/0298952 | A1 * | 11/2013 | Williams | A45B 11/02 135/22 |
| 2013/0313295 | A1 * | 11/2013 | Jacquette | A45B 11/02 224/190 |
| 2015/0296938 | A1 * | 10/2015 | Armina del Valle | A45B 11/02 135/161 |

* cited by examiner

DEPLOYMENT SYSTEM FOR PORTABLE CANOPY

FIELD OF THE INVENTION

This invention relates to a deployment system for a portable umbrella, and more particularly relates to a portable canopy that positions inside a backpack for hands free localized deployment of the canopy with a user-actuated mechanism.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In the prior art, an umbrella is a canopy designed to protect against rain or sunlight. Umbrellas are primarily hand-held portable devices designed to shield an individual from exposure, and are generally sized for personal use, though embodiments affixed to tables and other fixtures are known. The umbrella consists of a collapsible, usually circular canopy, mounted on a central rod.

Umbrellas provide a method of relief from various environmental discomforts. In warm climates, large umbrellas are used to provide shade and relief from strong sunlight, in order to provide a user with a more comfortable, cool environment as well as protection from sunburn and the like. Personal, extendable or extrudable umbrellas enjoy widespread use as a simple and effective means of providing individuals with a degree of protection from precipitation while outdoors. Umbrellas are well suited for keeping a user dry during rainfall, snowfall.

Typically, the effectiveness of an umbrella is predicated upon the localized area of protection and the ability of a user to stabilize the umbrella in a desired position within an immediate area. Often however, the small radius of common umbrellas, their handheld design, the fact that they may need to be adjusted due to the angle of the rain, and other similar concerns require a certain minimum expenditure of mental and physical effort on the part of the user. This results in a user having to use at least one hand to properly secure and place the umbrella while simultaneously concentrating on maintaining the umbrella in the proper position.

Umbrellas and are well known, as are their uses, whether for rain protection, sun protection, or fashion. One significant disadvantage to the common umbrella is that, in use, it necessarily occupies at least one of the user's hands.

In view of the foregoing, traditional canopies requiring at least one hand to hold are not perfect and leave room for more optimal approaches to actuating and controllably holding an umbrella.

SUMMARY

From the foregoing discussion, it should be apparent that a need exists for a canopy deployment system that provides a user with the hands free use of a canopy while obtaining protection from elements, such as gamma rays, moisture, and wind. The deployment system integrates with a backpack that fastens to the user. In this manner, the system controllably holds the canopy, and the user orients the canopy to a desired direction and angle without the use of hands. Beneficially, the system would enable the user to control the orientation of a protective canopy by bending, twisting, swiveling, and kneeling. This directional manipulation of the canopy may be performed hands free, whereby the user does not have to hold the canopy in a localized position, but rather, the system controllably holds the canopy while attached to the user, often to a back or torso section of the body.

The present invention has been developed in response to the present state of the art, and in particular, in response to the problems and needs in the art that have not yet been fully solved by currently available apparatus. In one embodiment of the present invention, the deployment system utilizes a portable canopy that positions inside a backpack for hands free localized positioning of the canopy, and provides a user-actuated mechanism for deploying and collapsing the canopy. The deployment system includes a canopy useful for shielding a user against the elements. The canopy may include a waterproof polymer fabric. A frame provides structural support and integrity to the canopy. The frame deploys and collapses, and is determinative of the position of the canopy. In one embodiment, the frame may include expandable and collapsible curved ribs that support the canopy.

In some embodiments, a central rod extends from the frame, controlling the configuration of the canopy between a deployed position and a collapsed position. A mechanism for moving between each position is regulated with a ring that encompasses and restricts the frame to form the collapsed position, and moves to release the frame for forming the deployed position. A release switch on a handle of the central rod regulates the ring.

A cylindrically shaped canopy container at least partially contains the canopy and the central rod. A bracket securely retains the central rod in a central section of the canopy container. For moving between the deployed and collapsed positions, the canopy container comprises a deploy cord and a collapse cord, whereby each cord extends out from the canopy container for facilitated access by a user.

A carry container forms a sleeve to contain the canopy container. The carry container attaches to the user, often in the form of a backpack strapped to the back of the user. In this manner, the user may reach behind to access the desired cord. In the deployed position, the user may receive hands free protection from the canopy.

In one embodiment, the user may deploy the canopy in an upward, outward orientation. The user may orient the canopy, which may attach to a back section of the user, to a desired direction by turning, bending, twisting, and stretching; all without having to use either hand while receiving protection from the element.

In a first aspect, the deployment system for deploying, controllably holding, and collapsing a portable canopy comprises: a canopy for providing at least partial protection from an element, the canopy comprising a frame for supporting the canopy; a central rod for controlling the configuration of the canopy between a deployed position and a collapsed position, the central rod comprising a ring, the ring being configured to traverse along a longitudinal axis of the central rod for restricting the frame to the collapsed position, the ring further being configured to traverse along the longitudinal axis of the central rod for releasing the frame to the deployed position, the central rod further comprising a release switch configured to control the position of the ring;

a canopy container for at least partially containing the canopy and the central rod, the canopy container comprising at least one bracket for securing the central rod, the canopy container comprising a deploy cord operatively connected to the release switch for actuating the canopy to the deployed position, the canopy container further comprising a collapse cord operatively connected to the ring for actuating the canopy to the collapse position; and a carry container for containing the canopy container, the carry container comprising at least one carry container fastener for attaching to a user, wherein the system controllably holds the canopy for protecting the user, wherein the user receives hands free localized positioning from the canopy.

In another aspect, the canopy and the central rod position inside the canopy container. The canopy container positions inside the carrying container. The carrying container fastens to a user.

In another aspect, the user actuates the system to a deployment position and a collapsed position with hands. The user may activate the system to automatically deploy the canopy in an upward, outward orientation. The user controls the orientation of the canopy and receives protection from the element without the use of hands.

In yet another aspect, the frame provides structural integrity for the canopy. The frame deploys and collapses, and is determinative of the position of the canopy. The frame attaches to the central rod and the ring.

In yet another aspect, the central rod includes a handle with a release switch. The release switch operatively joins with the ring for traversing the ring along a longitudinal axis of the central rod. The ring restricts the frame to form the collapsed position. The ring releases the frame to form the deployed position. The frame is biased to the deployed position.

In yet another aspect, the deploy cord joins with the release switch for actuating the deploy position, and the collapse cord joins with the ring for actuating the collapsed position.

One objective of the deployment system is to provide hands free localized positioning of the canopy.

Another objective is to provide a portable canopy that the user may be less likely to forget about since the system attaches to the user's back.

Another objective is to provide an inexpensive, simple system for providing hands free protection from the element.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
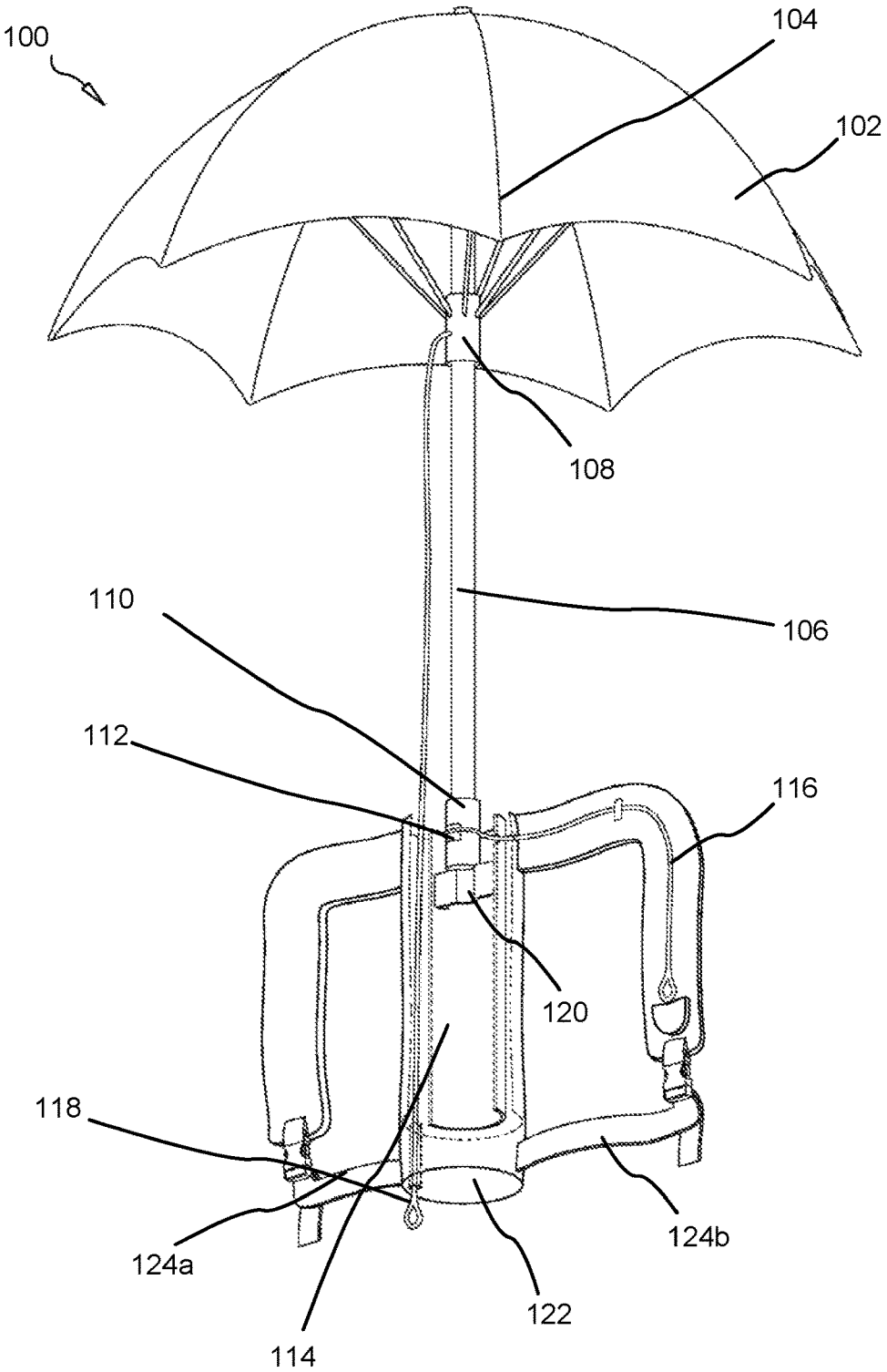
FIG. 1 is a sectioned lower perspective view of a deployment device in a deployed position in accordance with the present invention.

FIG. 1 is a sectioned lower perspective view of a deployment apparatus 100 in a deployed position in accordance with the present invention. FIG. 1 comprises a canopy 102, a frame 104, a central rod 106, a ring 108, a handle 110, a release switch 112, a canopy container 114, a deploy cord 116, a collapse cord 118, a bracket 120, a carry container 122, a carry container fastener 124*a*, and a carry container fastener 124*b*.

As referenced in FIG. 1, a deployment system 100 utilizes a canopy 102 for shielding a user against an element. The element may include, without limitation, gamma rays, moisture, rain, and wind. The canopy 102 may include a waterproof polymer fabric. However, in other embodiments, the material for the canopy 102 may include, without limitation, vinyl, polyester, and clear poly vinyl chloride. A frame 104 provides structural support and integrity to the canopy 102. The frame 104 deploys and collapses, and is determinative of the position of the canopy 102. For example, the frame 104 may include curved ribs that support the canopy 102. The curved ribs are shaped in a way that allows them to fan outward automatically when deployed. The curved ribs are configured to support the canopy 102 when actuated to a deployed position, and collapse for storage when actuated to a collapsed position by pulling on the collapse cord 118.

In some embodiments, a central rod 106 extends from the frame 104, controlling the configuration of the canopy 102 between the deployed position and the collapsed position. The central rod 106 includes a handle 110 with a release switch 112. In one embodiment, the handle 110 is linear, joining at a terminal end of the central rod 106, and includes a diameter of 1" and a length of 2". The release switch 112 operatively joins with the ring 108 for traversing the ring 108 along a longitudinal axis of the central rod 106. The ring 108 moves to restrict the frame 104 to form the collapsed position. The ring 108 moves along the central rod 106 to release the frame 104 to form the deployed position. The frame 104 is biased to the deployed position. In one embodiment, the central rod 106 may include a telescoping rod.

A mechanism for moving between the deployed position and the collapse position is regulated with a ring 108 that encompasses and restricts the frame 104 to form the collapsed position, and moves to release the frame 104 for forming the deployed position. A release switch 112 on the handle 110 of the central rod 106 regulates the ring 108. However, the mechanism for moving between the deployed position and the collapsed position may include other means, such as a spring release system, a telescoping rod system, and an air piston system. In the deployed position, the central rod 106 may include a 19" length. In the collapsed position, the central rod 106 may include a length of 11". In one alternative embodiment, a rotary device (not shown) adjustably connects the central rod 106 to the frame 104, thereby providing an adjustable and lockable angular adjustment for the canopy 102. The rotary device may include parallel, grooved discs that rotate to enable relative angle movement.

Figure 2:
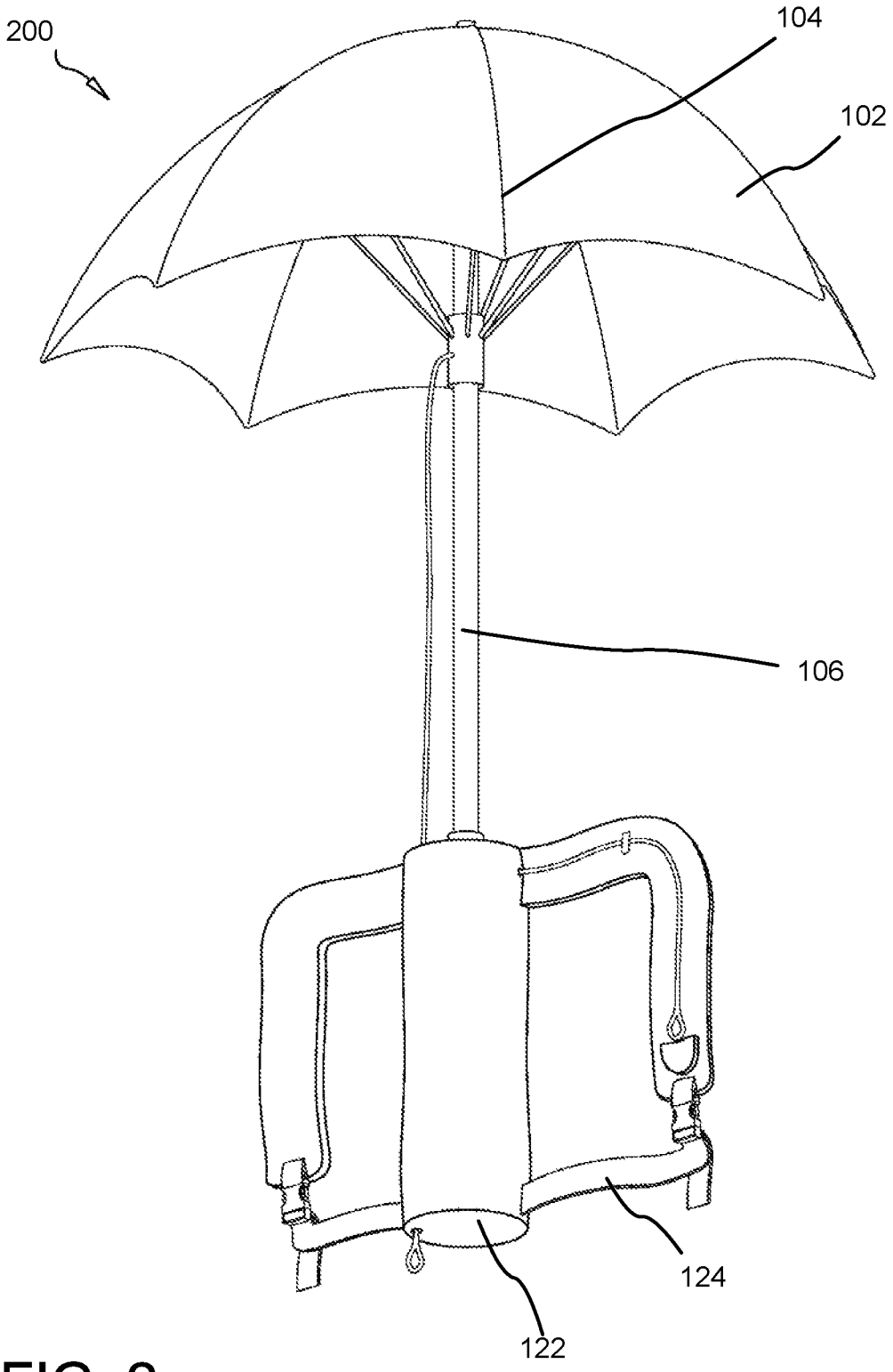
FIG. 2 is a lower perspective view of a deployment device in a deployed position in accordance with the present invention.

FIG. 2 is a lower perspective view of a deployment device 200 in a deployed position in accordance with the present invention. The device 200 comprises a canopy 102, a frame 104, a central rod 106, a carry container 122, and a carry container fastener 124.

Figure two serves primarily to show the canopy 200 in a deployed configuration.

Figure 3:
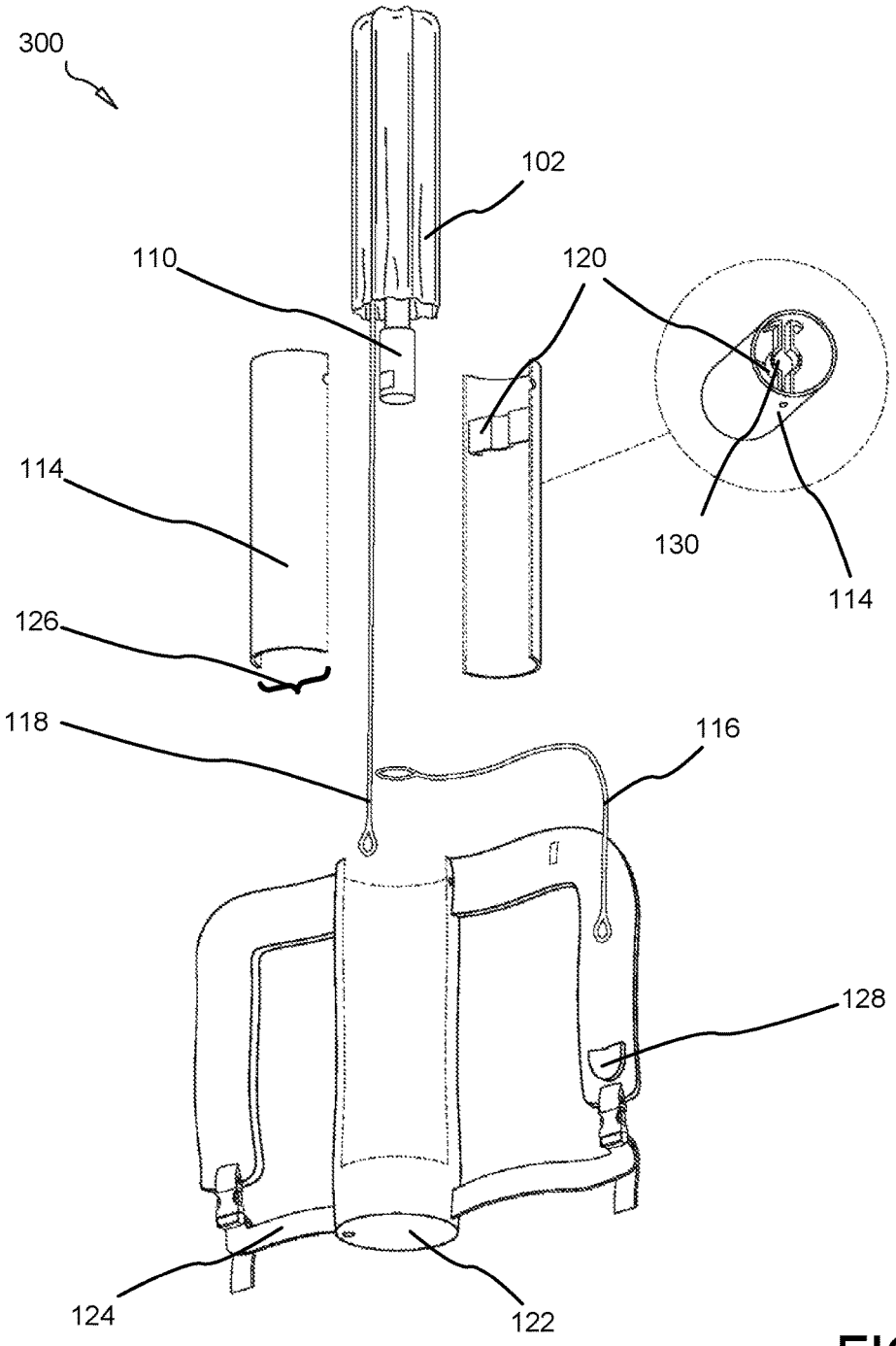
FIG. 3 is a sectioned lower perspective view of a deployment device in an undeployed position in accordance with the present invention.

FIG. 3 is a sectioned lower perspective view of a deployment device 300 in an undeployed position in accordance with the present invention. The device 300 comprises a deploy cord 116, a carry container 122, a carry container fastener 124, a collapse cord 118, a deploy cord 116, a canopy container 114, an aperture 130, and bracket 120.

FIG. 3 illustrates a cylindrically shaped canopy container 114 that at least partially contains the canopy 102 and the central rod 106. The canopy container 114 may be dimensioned with a 2" diameter and a 9" length. A deploy cord 116 extends from an upper portion of the canopy container 114 and stores in a deploy cord pocket 128 for storage. The deploy cord 116 joins with the release switch 112 for actuating the deploy position. The deploy cord 116 may extend along two sides of the frame 104 and terminate at the release switch 112 in the handle 110. The deploy cord 116 is oriented such that the user may reach behind to access a terminal end of the deploy cord 116. In one embodiment, the deploy cord 116 may include a length of 19". The deploy cord 116 pocket includes a hook and loop fastener to regulate access to and retain a terminal end of the deploy cord 116. The deploy cord pocket 128 may contain a majority of the deploy cord 116, or a terminal end of the deploy cord 116.

A collapse cord 118 extends from a lower portion of the canopy container 114. The collapse cord 118 joins with the ring 108 for actuating the collapsed position. In one embodiment, the collapse cord 118 may include a length of 26½". The collapse cord 118 pocket includes a hook and loop fastener to regulate access to and retain a terminal end of the collapse cord 118 for storage. The collapse cord pocket 126 may contain a majority of the collapse cord 118, or a terminal end of the collapse cord 118.

At least one bracket 120 securely retains the handle 110 from the central rod 106. The at least one bracket 120 may position the handle 110 in a central section of the canopy container 114. In one embodiment, the at least one bracket 120 may include two U-shaped brackets 120 having a circular center configured to snugly receive the central rod 106 and/or the handle 110. Each bracket 120 may position about 1" apart from each other. The at least one bracket 120 may be dimensioned 2½ in length and 1" wide. The at least one bracket 120 may position around the central rod 106, about 2½" from an upper rim of the canopy container 114. At least one aperture 130 in the at least one bracket 120 provides a place for a bracket fastener to secure the at least one bracket 120 to the handle 110. In one embodiment, the at least one aperture 130 includes four screw holes, whereby four screws pass through and into the handle 110.

Turning now to FIG. 2, a carry container 122 forms a sleeve to contain the canopy container 114. The canopy container 114 may attach to the carry container 122 through any fastening means. In one embodiment, the canopy container 114 may include four holes for enabling four container fasteners to securely attach the canopy container 114 to the carry container 122. In yet another embodiment, the carry container 122 may comprise a canvas backpack having dimensions of 11"×3½". However, in other embodiments, the carry container 122 may include, without limitation, a rucksack, a knapsack, a packsack, and a cloth sack carried on a back section of the body and secured with two or more straps configured to be operable to wrap around the shoulders. Those skilled in the art will recognize that a backpack quickly attaches to the user by strapping to the back of the user. This adornment enables the user to control the position of the backpack for orienting the canopy 102 when deployed. The proximal position of the backpack to the hands enables the user may reach behind to access the deployment cord and the collapse cord 118. Yet, when the canopy 102 is in the deployed position, the user may receive hands free protection from the canopy 102.

In some embodiments, the carry container 122 may include at least one carry container fastener 124 for securing the carry container 122 to the user, often to the back. The at least one carry container fastener 124 may include two straps of adjustable 26" length that are configured to be operable to wrap around the shoulders of the user while the carry container 122 rests flush against the back section of the body. However, in other embodiments, the at least one carry container fastener 124 may include, without limitation, clips, magnets, pins, and hooks.

Figures 4A, 4B:
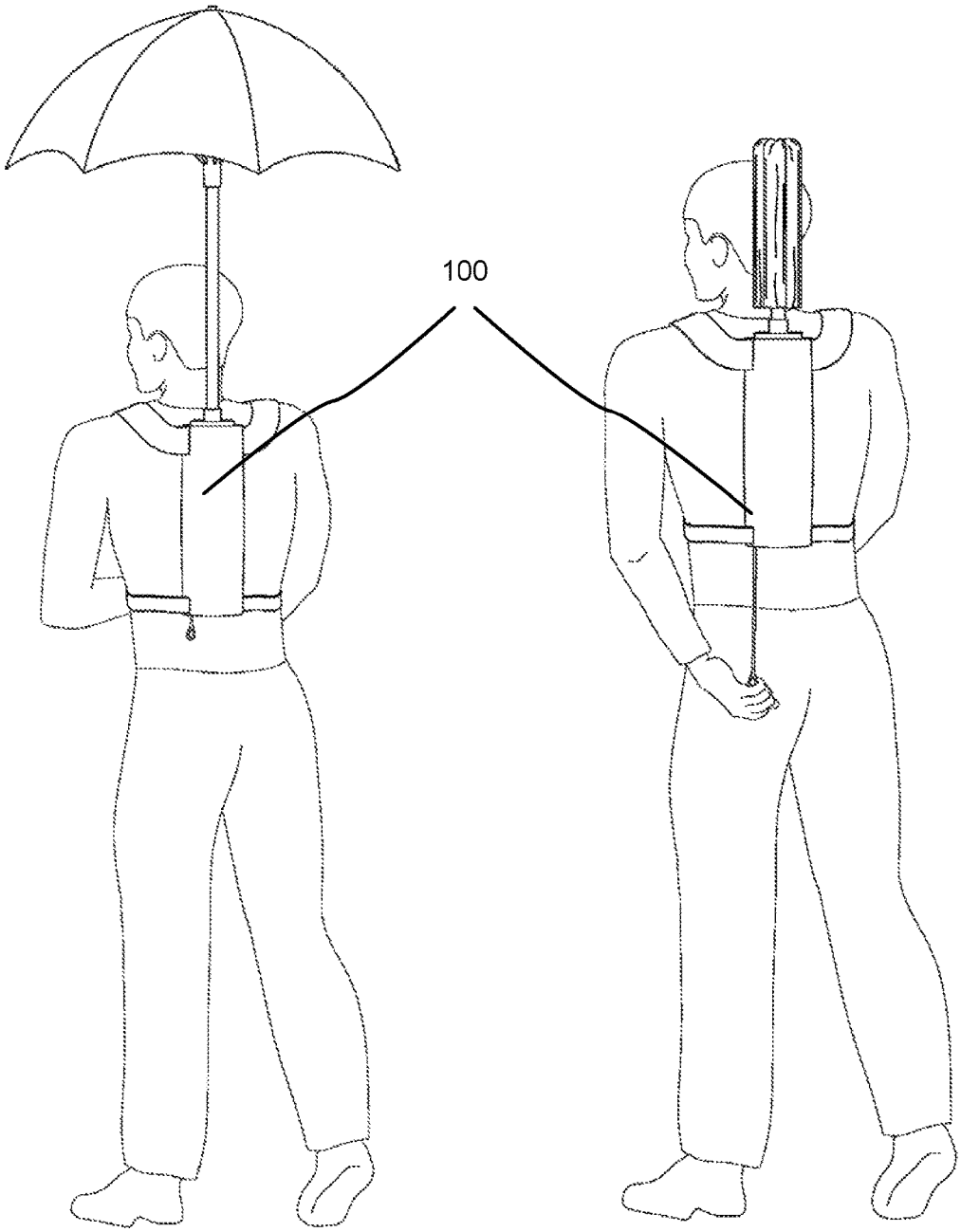
FIG. 4A is an environmental perspective view of a deployment device in a deployed position in accordance with the present invention.
FIG. 4B is an environmental perspective view of a deployment device in a deployed position in accordance with the present invention.
Figure 5:
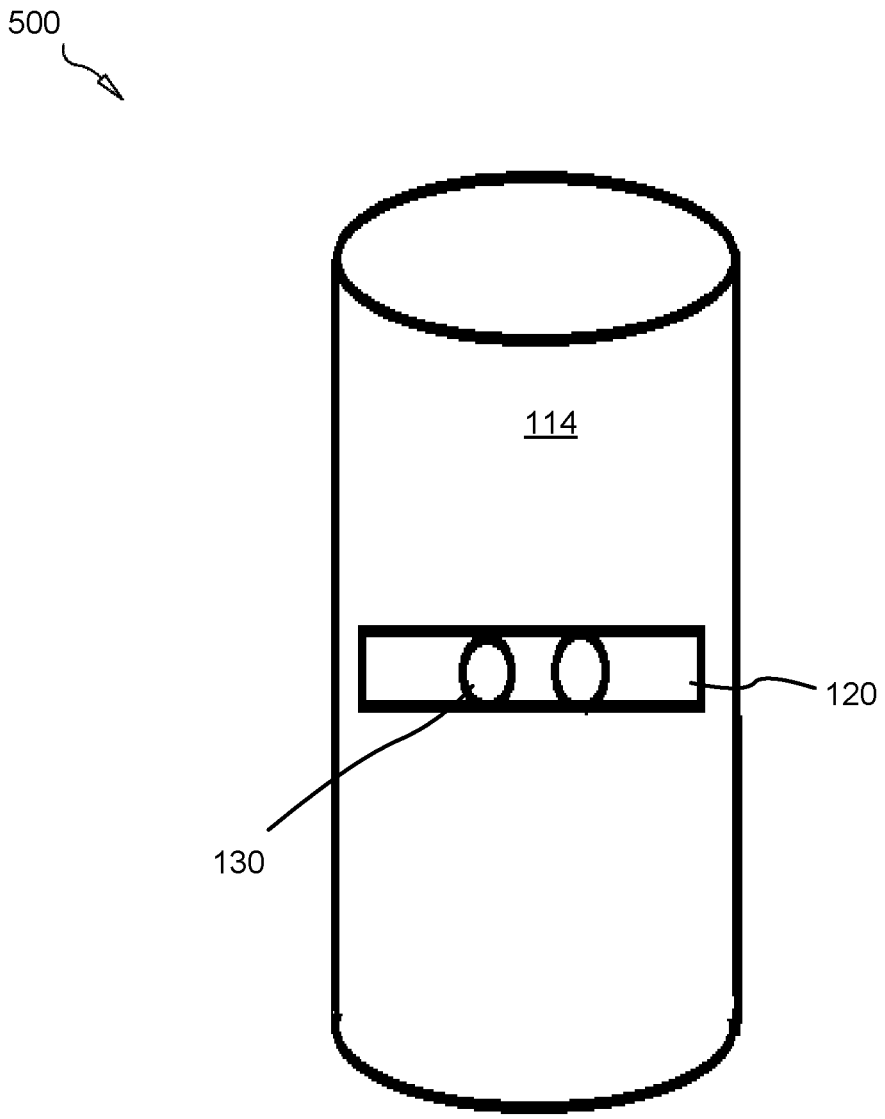
FIG. 5 is a detailed perspective view illustrating an exemplary canopy container in a collapsed position and a bracket, in accordance with the present invention.
Figure 6:
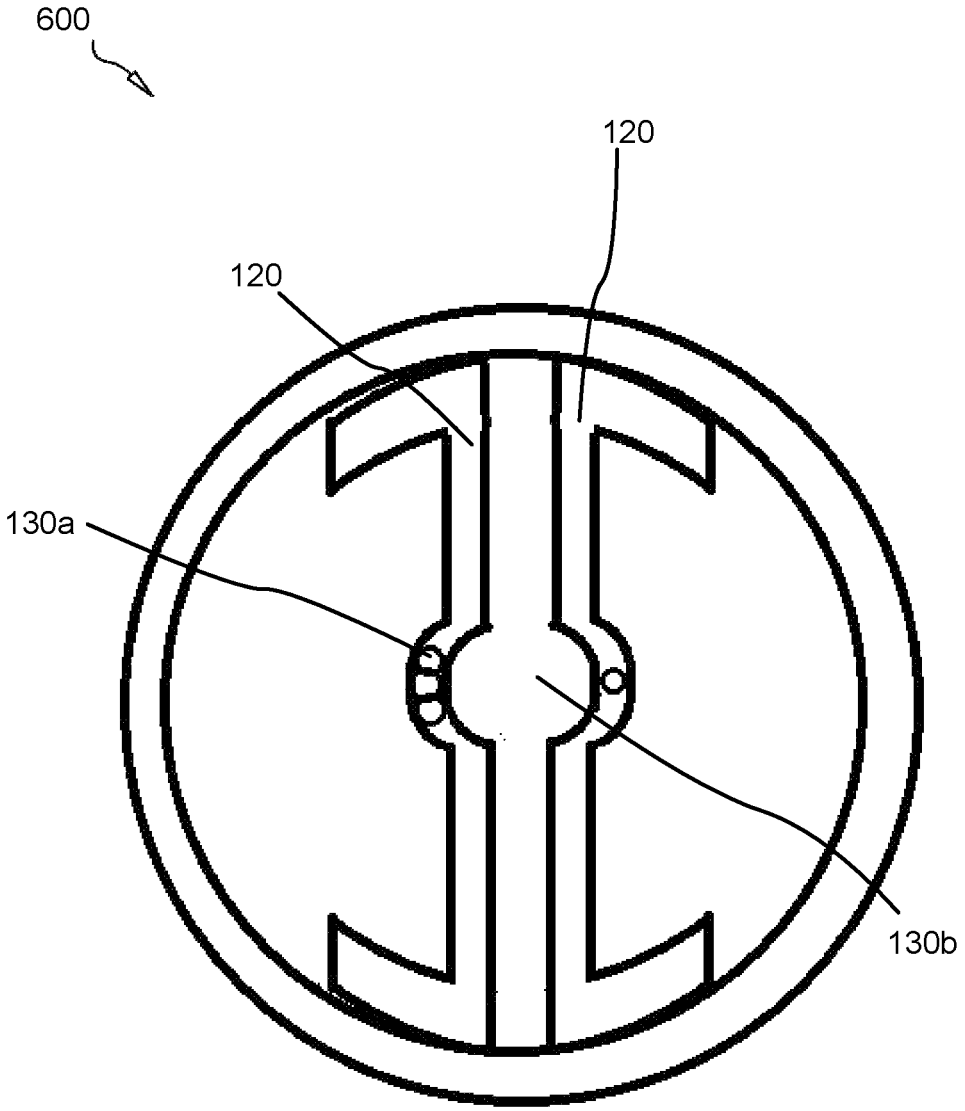
FIG. 6 is a top view illustrating an exemplary canopy container with a bracket inside, in accordance with the present invention.
Figure 7:
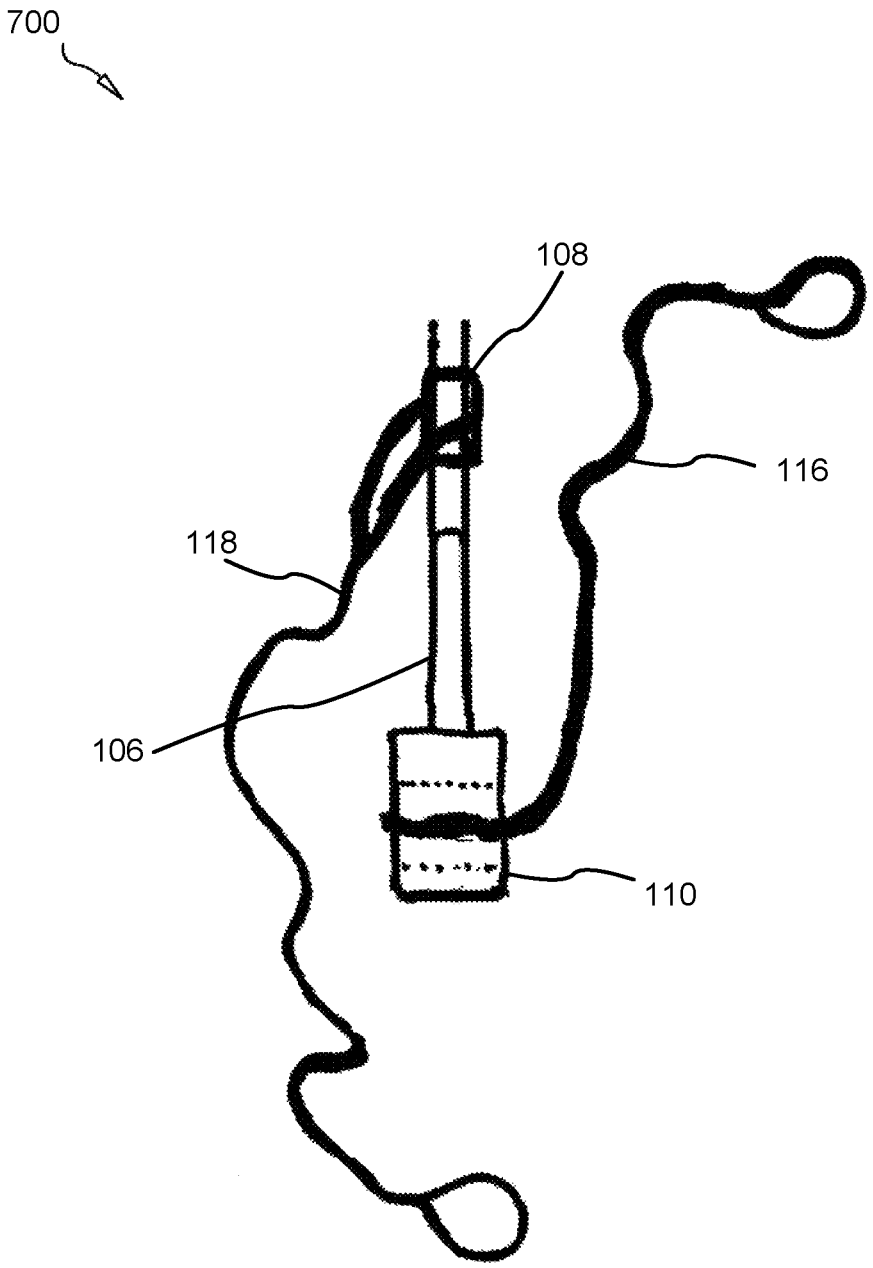
FIG. 7 is a detailed perspective view illustrating an exemplary deploy cord joined with a release switch, and a collapse cord joined with a ring, in accordance with the present invention.

FIG. 4A is an environmental perspective view of a deployment device in a deployed position in accordance with the present invention. FIG. 4A shows the device 100 in use by a user and before being deployed as shown in FIG. 4B below.

The deployment system 100 may move between the deployed and collapsed positions through the utilization of a deploy cord 116 and a collapse cord 118, whereby each cord 116, 118 extends out from the canopy container 114 for facilitated access by a user. The deploy cord 116 extends from an upper portion of the canopy container 114 and stores in a deploy cord 116 pocket for storage. The deploy cord 116 joins with the release switch 112 for actuating the deploy position. The collapse cord 118 extends from a lower portion of the canopy container 114 and stores in a collapse cord 118 pocket. The collapse cord 118 joins with the ring 108 for actuating the collapsed position, whereby the collapse cord 118 moves the ring 108 from a restrictive position on the frame 104.

In one embodiment, the user may deploy the canopy 102 in an upward, outward orientation. The user may orient the canopy 102 to a desired direction by turning, bending, twisting, and stretching. This localized positioning of the canopy 102 may be possible without having to use either hand while still receiving protection from the elements. Additionally, the user may remove the carry container 122 position the canopy 102 to a desired area.

In one alternative embodiment, the carry container 122 of the deployment system 100 may be adorned from a chest section of the body, rather than a back section. In yet another alternative embodiment, the canopy 102 may be actuated to deploy and collapse remotely. A motor may power the ring 108 or other mechanism to deploy and collapse the frame 104 and canopy 102. In yet another alternative embodiment, a rotary device positions between the central rod 106 and the frame 104. The rotary device swivels and locks into place for enabling relative angular movement of the canopy 102. In yet another alternative embodiment, an outer backpack may position on top of the carry container 122 for providing additional storage space.

FIG. 4B is an environmental perspective view of a deployment device in a deployed position in accordance with the present invention. FIG. 4*b* shows the device 100 in use by an operator after the canopy 102 has been collapsed. The canopy 102 is collapsed by pulling on the collapse cord 118.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A deployment system for deploying, controllably holding, and collapsing a portable canopy, the deployment system comprising:

a canopy for providing at least partial protection from an element, the canopy comprising a frame for supporting the canopy;

a central rod for controlling the configuration of the canopy between a deployed position and a collapsed position, the central rod comprising a ring, the ring being configured to traverse along a longitudinal axis of the central rod for restricting the frame to the collapsed position, the ring further being configured to traverse along the longitudinal axis of the central rod for releasing the frame to the deployed position, the central rod further comprising a release switch configured to control the position of the ring;

a canopy container for at least partially containing the canopy and the central rod, the canopy container comprising at least one bracket for securing the central rod, the canopy container comprising a deploy cord operatively connected to the release switch for actuating the canopy to the deployed position, the canopy container further comprising a collapse cord operatively connected to the ring for actuating the canopy to the collapse position;

the at least one bracket comprising two U-shaped brackets defining an aperture for retaining the central rod; and a carry container for containing the canopy container, the carry container comprising at least one carry container fastener for attaching to a user;

wherein the system controllably holds the canopy for protecting the user;

wherein the user receives hands free protection from the canopy.

2. The system of claim 1, in which the canopy comprises a waterproof polymer fabric suitable for at least partially blocking the element.

3. The system of claim 1, in which the element comprises gamma rays, and/or moisture, and/or wind.

4. The system of claim 1, in which the canopy is biased towards the deployed position.

5. The system of claim 1, in which the collapsed position comprises the canopy at least partially collapsing into the canopy container.

6. The system of claim 1, in which the central rod comprises a telescoping configuration.

7. The system of claim 1, in which the release switch comprises a release button, or a pull cord, or an air-inflation actuator.

8. The system of claim 1, in which the canopy container comprises a substantially cylindrical shape.

9. The system of claim 1, in which the carry container comprises a deploy cord pocket for at least partially containing a terminal end of the deploy cord.

10. The system of claim 1, in which the collapse cord extends from a lower portion of the canopy container and stores in a collapse cord pocket.

11. The system of claim 1, in which the carry container comprises a collapse cord pocket for at least partially containing a terminal end of the collapse cord.

12. The system of claim 1, in which the carry container comprises a back pack.

13. The system of claim 1, in which the carry container comprises a canvas fabric, the carry container further comprising dimensions of 11"×3½".

14. The system of claim 1, in which the at least one carry container fastener comprises four straps for attaching to the user.

15. A deployment system for deploying, controllably holding, and collapsing a portable canopy, the deployment system comprising:

a canopy for providing at least partial protection from an element;

a central rod for controlling the configuration of the canopy between a deployed position and a collapsed position;

a canopy container for at least partially containing the canopy and the central rod, the canopy container comprising a deploy cord for actuating the canopy to the deployed position, the canopy container further comprising a collapse cord for actuating the canopy to the collapse position;

a bracket in the canopy container, the bracket comprising two U-shaped brackets defining an aperture for retaining the central rod; and a carry container for containing the canopy container and attaching to a user, wherein the system controllably holds the canopy for protecting the user, wherein the user receives hands free localized positioning from the canopy.

* * * * *